United States Patent [19]

Spronken

[11] Patent Number: 4,989,382

[45] Date of Patent: Feb. 5, 1991

[54] CONNECTORS FOR CONCRETE STRUCTURAL ELEMENTS

[76] Inventor: John R. Spronken, Suite 103, 1400 Kensington Road, N.W., Calgary, Alberta, Canada, T2N 3P9

[21] Appl. No.: 441,531

[22] Filed: Nov. 27, 1989

[30] Foreign Application Priority Data

Nov. 25, 1988 [CA] Canada ..... 584172

[51] Int. Cl.[5] ..... E04B 1/21; E04H 13/00

[52] U.S. Cl. ..... 52/252; 52/134; 52/136; 52/236.3; 52/236.9

[58] Field of Search ..... 52/252, 134, 79.14, 52/236.9, 601, 136, 236.3, 610–611

[56] References Cited

U.S. PATENT DOCUMENTS

| | | | |
|---|---|---|---|
| 3,642,339 | 2/1972 | Ruderfer | 52/134 |
| 3,762,115 | 10/1973 | McCaul, III et al. | 52/79.14 |
| 3,878,656 | 5/1975 | Duwe | 52/134 |
| 3,938,287 | 2/1976 | Gauchard | 52/134 |
| 4,048,772 | 9/1977 | Gaul | 52/236.9 |
| 4,132,046 | 1/1979 | Duwe et al. | 52/745 |

FOREIGN PATENT DOCUMENTS

| | | | |
|---|---|---|---|
| 2357556 | 5/1974 | Fed. Rep. of Germany | 52/601 |

*Primary Examiner*—Richard E. Chilcot, Jr.
*Assistant Examiner*—Deborah M. Ripley

[57] ABSTRACT

A connector assembly is described for concrete structural elements, such as concrete crypt modules for mausoleum structures. The connector assembly includes a top corner member connectable to a concrete structural element with a horizontal top plate extending along the top of the structural element and a vertical edge plate extending down one side of the structural element. The vertical edge plate has an inwardly stepped portion extending downwardly from the top of the structural element and terminating in a horizontal shelf portion and the horizontal top plate has a recess adapted to extend into the concrete. One edge of the recess and the top end of the vertical edge plate have opposed interlock projections. The assembly also includes an interlock plate means having projections for engaging the opposed interlock projections and one edge of the plate means has a downwardly projecting flange terminating above the corner member shelf portion. The downwardly projecting flange and shelf form therebetween a pocket for retaining the end flange of a projecting connector of an adjacent concrete structural element.

7 Claims, 3 Drawing Sheets

CONNECTORS FOR CONCRETE STRUCTURAL ELEMENTS

BACKGROUND OF THE INVENTION

1. Field of the Invention

This invention relates to connectors for concrete structural elements and, more particularly, to the use of such connectors for connecting concrete crypt modules for mausoleum structures.

2. Description of the Prior Art

As available land becomes scarcer, there is an increasing demand for more efficient utilization of land, especially for burial purposes in areas where the population growth is large. One of the solutions to this problem is the use of above-ground mausoleums, similar in concept to highrise apartments. The advantages of the above-ground, multi-level mausoleums are readily evident since this system permits a more efficient utilization of land and has the added advantage of permitting visitors to be indoors while paying respects to the deceased. This is of special interest in cold northern climates.

A variety of different construction techniques have been employed for constructing multi-level, above-ground mausoleums. For instance, one technique is a poured-in-place method such as that used in apartment construction. While this technique produces a highly satisfactory product, it is both a slow and very expensive construction technique.

There are also various techniques employing precast concrete structural elements and one such modular mausoleum crypt system is described in U.S. Pat. No. 3,878,656, issued May 22, 1975. In that system, the modules are joined together by means of an adhesive or cement. Such a system functions very well provided there is no movement in the supporting medium. However, if the floor or supporting medium deflects in any manner, the joints between the modules may separate to the point of collapse of the structure.

It is the object of the present invention to provide a modular crypt system in which the modules are joined together by techniques which require neither adhesives nor grout. It is of particular interest to provide such systems which will allow structural movement without showing signs of distress.

SUMMARY OF THE INVENTION

The present invention in its broadest aspect relates to a connector assembly for connecting concrete structural elements, such as concrete crypt modules. The connector assembly comprises as one component a top corner member connectable to a concrete structural element with a horizontal top plate extending along the top of the structural element and a vertical edge plate extending down one side of the structural element. The vertical leg has an inwardly stepped portion extending downwardly from the top of the structural element and terminating in a horizontal shelf portion and the horizontal top plate has a recess adapted to extend into the concrete. One edge of the recess and the top end of the vertical edge plate have opposed interlock projections. A second part of the connector assembly is an interlock plate means having projections for engaging the opposed interlock projections, with one edge of the plate means having a downwardly projecting flange terminating above the corner member shelf portion, the downwardly projecting flange and shelf forming therebetween a pocket for retaining the end of a L- or T-shaped connector of an adjacent concrete structural element.

The interlock plate means may conveniently be formed as two adjacent plates, each with an interlock projection and one having a downwardly projecting flange. The adjacent interlock plates are then held in place by means of a saddle member which rests over the plate. This saddle member forms a base support for a side wall of a next level of crypt modules.

The connector elements are formed as part of the concrete structural elements during the casting process. They provide for a very simple, yet strong and safe connection between the structural elements. Thus, for the purpose of assembly, the L- or T-shaped portion of the male connector is placed on the horizontal shelf portion of the female connector. In this manner, the horizontal shelf portion functions as a complete support for the adjacent structural element. Then, the interlock plate or plates are placed in position with the downwardly projecting flange being located to form a pocket which retains the end of the L- or T-shaped connector. Thus, the L- or T-shaped connector is permitted to move laterally while sliding along the shelf portion but is limited in its lateral movement by engagement between the L- or T-shaped section and the downwardly projecting flange.

Thus, if the floor or supporting medium deflects, a stack of modular units is permitted to move relative to the adjoining stack because of the permitted movement between the connector elements while still retaining its total structural integrity.

Figure 1:
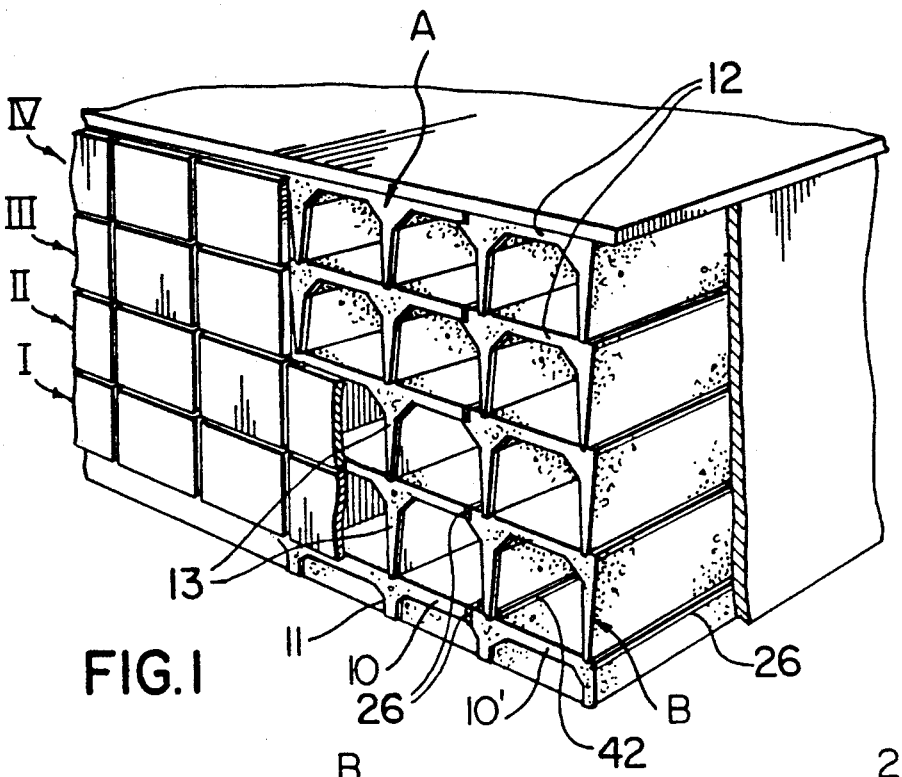
FIG. 1 is a brief pictorial representation of an illustrative embodiment of a mausoleum construction according to the present invention, with portions removed to show internal features.

A typical mausoleum construction utilizing the connectors of the present invention is shown in FIG. 1. This is a four tier structure, each tier being represented by the symbols I, II, III and IV. The four tier mausoleum is supported by a concrete base structure including support elements 10 and 10' with short supporting legs 11.

Each of the tiers, I–IV, includes a plurality of assembled precast modular units, preferably of reinforced concrete, connected to each other by the connectors of this invention to form a unitary structure.

Figure 2:
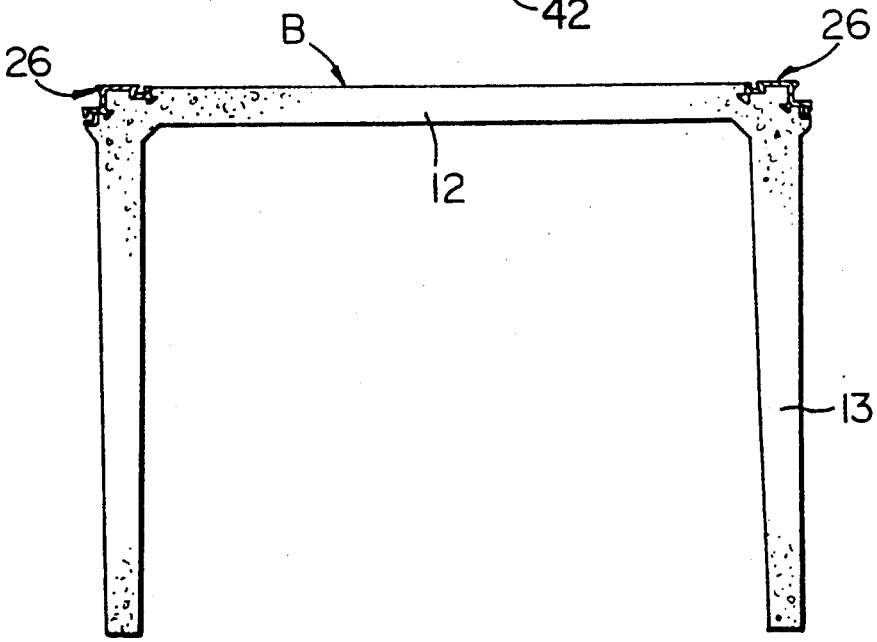
FIG. 2 is an end elevation of a concrete structural element having a pair of corner connectors.
Figure 3:
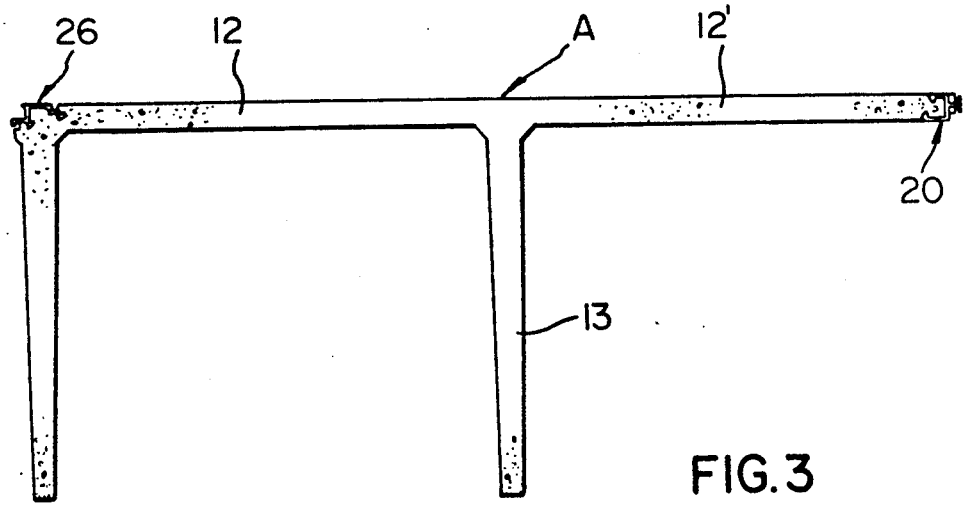
FIG. 3 is an end elevation of a structural element having a corner connector and an L- or T-connector.

For constructing the modular structure of FIG. 1, two types of structural elements are preferably used, these being structural element B as shown in FIG. 2 and structural element A as shown in FIG. 3. The modular unit B includes a pair of spaced, upstanding side walls 13, the spacing between the side walls being of predetermined width, to form a crypt cavity. This modular unit further includes an upper, horizontally disposed slab 12 which is integrally formed with the side walls 13. Each corner of the modular unit B includes an embedded top corner connector member 26.

The second modular unit A is similar to modular unit B in having a pair of spaced, upstanding side walls 13, spaced to form a crypt cavity, and an upper, horizontally disposed slab 12 which is integrally formed with side walls 13. However, the modular unit shown in FIG. 3 also has an upper slab extension 12' which extends beyond side wall 13 in cantilevered fashion to provide a free end which holds an L- or T-shaped connector 20 of the invention. The modular units A and B may be connected together in the pattern shown in FIG. 1 to construct a mausoleum.

Figure 4:
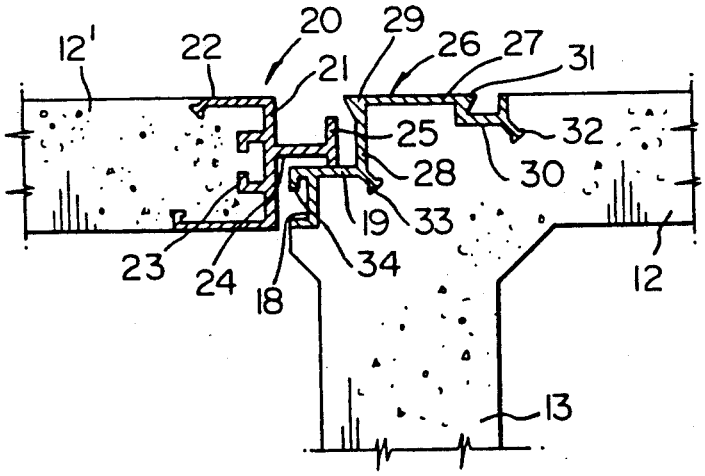
FIG. 4 is a sectional view showing the assembly of two structural elements.
Figure 5:
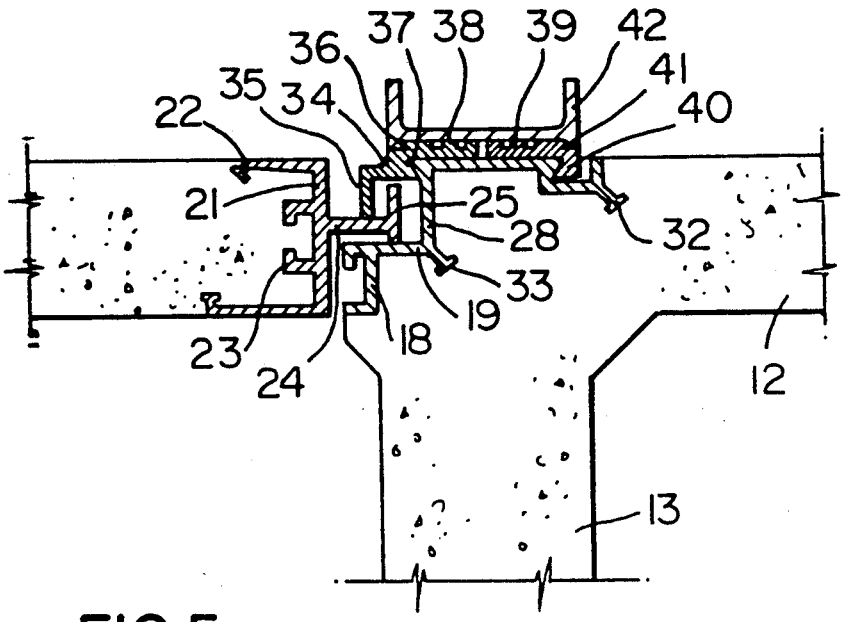
FIG. 5 is a sectional view showing a further stage in the assembly of two structural elements.
Figure 6:
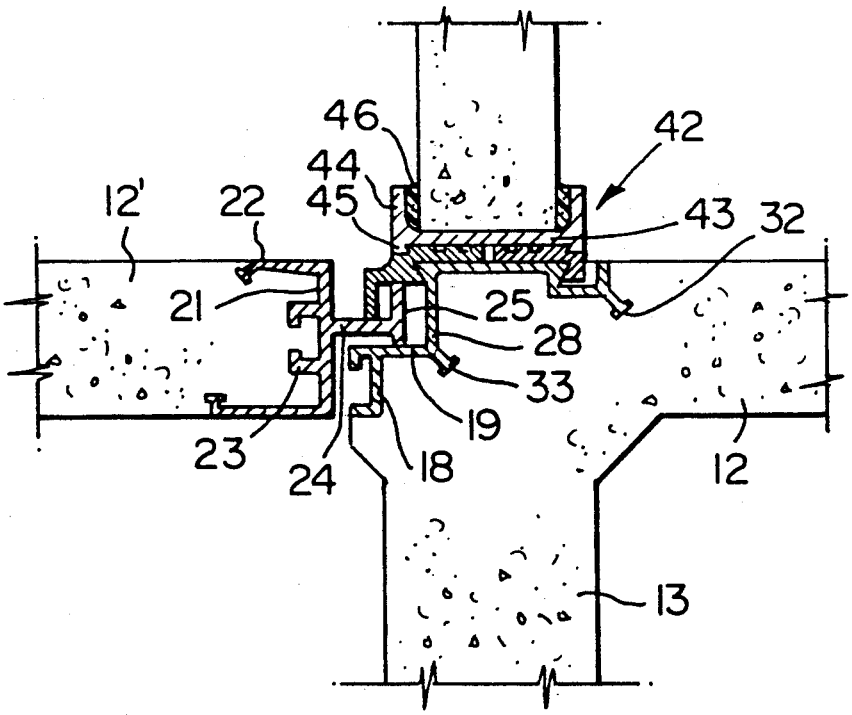
FIG. 6 is a sectional view showing the completion of the assembly of two structural elements.

Details of the connectors themselves are shown in FIGS. 4 to 6. Looking first at the corner connector assembly 26, it includes a horizontal top plate 27, an edge plate 28 upper vertical, a horizontal shelf portion 19 and a further lower vertical edge plate 18. The top plate 27 includes a recessed portion 30 with an anchor 32 extending inwardly therefrom to anchor in the concrete. The recess 30 also includes a tapered edge portion 31 serving as an interlock. A second tapered edge 29 is provided as an extension of the opposite end of top plate 27.

A further inwardly projecting anchor 33 is provided at the corner between edge plate 28 and shelf 19. A lip portion 34 is provided as a means for receiving a clamp during construction of a concrete module.

The second component of the connector 20 is connected to a free end of upper slab extension 12' and it is in the form of a casting with side plates 22 and an end plate 21. The end plate 21 has a pair of inward projection 23 providing locking means within the concrete. Extending outwardly from end plate 21 is a web portion 24 terminating in a flange 25.

As seen in FIG. 4, the first step in assembly of the connectors of this invention is to place the T-portion 25 of connector 20 on shelf portion 19 of connector 26. In this manner, the upper slab extension 12' of modular unit A is supported by the corner of modular unit B.

Next, a pair of interlock plates 38 and 39 are used which are placed on top of top plate 27. Plate 39 includes a downwardly projecting lip 40 and an edge stepped portion 41. The lip 40 engages and interlocks with the tapered edge 31 of recess 30. Plate 38 has a downwardly projecting lip portion 37 for interlocking engagement with the second tapered edge 29. The outer end of plate 38 also includes a stepped portion 36 and a downwardly projecting flange 35. This flange 35 extends downwardly above web portion 24 thereby forming a pocket within which is retained the T-portion 25.

In order to hold the plates 38 and 39 in position, a saddle or socket member 42 is placed on top of plates 38 and 39. This socket member has at the outer bottom corners thereof downward projections 45 adapted to engage the stepped portions 36 and 41 of plates 38 and 39 respectively. The socket member also includes a bottom plate 43 and side pieces 44.

A leg 13 of a next higher tier is placed in the socket and the space surrounding the leg is filled with silicon caulking 46. This provides two functions. Firstly, it provides a cushion against concentrated loads and secondly, it locks the units together once aligned thereby providing stability for each vertical stack.

Many modifications and variations of the present invention, other than those described herein, are possible in light of the above teachings and within the purview of the appended claims without departing from the spirit and intended scope of the invention. For instance the connector assemblies may be in the form of continuous strips running along the full lengths of the crypt modules or they may be in the form of short sections spaced along the length of each module.

I claim:

1. A connector assembly for concrete structural elements, said connector assembly comprising (a) a top corner member connectable to a concrete structural element with a horizontal top plate extending along the top of the structural element and a vertical edge plate extending down one side of the structural element, said vertical edge plate having an inwardly stepped portion extending downwardly from the top of the structural element and terminating in a horizontal shelf portion and said horizontal top plate having a recess adapted to extend into the concrete, one edge of said recess and the top end of the vertical edge plate having opposed interlock projections and (b) interlock plate means having projections for engaging said opposed interlock projections and one edge of said plate means having a downwardly projecting flange terminating above the corner member shelf portion, said downwardly projecting flange and shelf forming therebetween a pocket for retaining an end flange of projecting connector of an adjacent concrete structural element.

2. A connector assembly according to claim 1 wherein the interlock plate means comprises a pair of adjacent plates.

3. A connector assembly according to claim 1 wherein the top corner member is fixed to a top corner of a concrete crypt module.

4. A connector assembly according to claim 3 wherein said projecting connector is fixed to a projecting top slab portion of a further concrete crypt module.

5. A connector assembly according to claim 4 which further comprises a socket member mounted on to p of said interlock plate and having upturned socket opening to receive a side leg of a concrete crypt module.

6. A connector assembly according to claim 5 wherein the socket member includes downwardly extending projections for engaging abutments in said interlock plate.

7. A crypt module for mausoleum structures comprising: an upper, horizontally disposed slab; a pair of spaced side walls having respective longitudinal axes and depending from said upper slab, the spacing between said side wall being of predetermined width to form a crypt cavity; (iii) one end of said upper slab forming a corner with a first of said side walls and a second end of said upper slab extending beyond a second of said side walls for a predetermined distance in cantilevered fashion and terminating at a free edge; (ii) a connector assembly mounted on said corner with a horizontal top plate extending along the top of the upper slab and a vertical edge plate extending down one side of said first side wall, said vertical edge plate having an inwardly stepped portion extending downwardly from the top of the module and terminating in a horizontal shelf portion interlock plate means mounted on said horizontal top plate with said interlock plate having a downwardly projecting flange terminating above said shelf portion and forming a retaining pocket therewith and (v) a connector piece mounted on the upper slab free end and having a horizontally extending web portion terminating in an outer flange, said flange being adapted to be retained in a said retaining pocket of an adjacent module.

* * * * *